US005110258A

United States Patent [19]

Morinushi et al.

[11] Patent Number: 5,110,258

[45] Date of Patent: May 5, 1992

[54] BLOWER HAVING A SOUND-DAMPING STRUCTURE

[75] Inventors: Ken Morinushi; Hideharu Tanaka, both of Amagasaki; Yoshihiro Noguchi, Hanazono; Toshihisa Imai, Hanazono; Yutaka Takahashi, Hanazono, all of Japan

[73] Assignees: Mitsubishi Denki Kabushiki Kaisha, Tokyo; Mitsubishi Electric Home Appliance Co., Ltd., Saitama, both of Japan

[21] Appl. No.: 561,685

[22] Filed: Aug. 2, 1990

[30] Foreign Application Priority Data

Aug. 9, 1989 [JP] Japan ..... 1-204881

[51] Int. Cl.[5] ..... F01D 5/10

[52] U.S. Cl. ..... 415/119; 181/224; 181/225

[58] Field of Search ..... 181/224, 225, 282; 415/119, 200

[56] References Cited

U.S. PATENT DOCUMENTS

| | | | |
|---|---|---|---|
| 3,485,443 | 12/1969 | Earhart . | |
| 3,540,547 | 11/1970 | Coward . | |
| 3,709,774 | 1/1973 | Kimura . | |
| 3,718,532 | 2/1973 | Hayes, Jr. | 161/159 |
| 3,890,060 | 6/1975 | Lipstien . | |
| 3,947,148 | 3/1976 | Holt | 181/225 |
| 4,234,291 | 11/1980 | Hurst et al. | 415/200 |
| 4,296,831 | 10/1981 | Bennett | 181/224 |
| 4,807,718 | 2/1989 | Lotz | 181/225 |

FOREIGN PATENT DOCUMENTS

| | | | |
|---|---|---|---|
| 601856 | 8/1934 | Fed. Rep. of Germany . | |
| 1095504 | 12/1960 | Fed. Rep. of Germany | 181/224 |
| 7603995 | 6/1970 | Fed. Rep. of Germany . | |
| 639492 | 6/1928 | France | 181/224 |
| 61-114000 | 7/1986 | Japan . | |
| 61-192898 | 8/1986 | Japan . | |
| 1333861 | 8/1987 | U.S.S.R. | 415/119 |
| 967100 | 8/1964 | United Kingdom | 415/119 |

*Primary Examiner*—Thomas E. Denion

*Attorney, Agent, or Firm*—Oblon, Spivak, McClelland, Maier & Neustadt

[57] ABSTRACT

A blower comprises an impeller which can function to raise the pressure of a fluid and delivers it; a driving device for driving the impeller; and a fan casing which includes a fluid path to inspire the fluid from the outside and deliver it to the outside through the impeller; wherein the fan casing is at least partly formed by a hard porous structural unit whose specific gravity is continuously changed in at least one of the direction of thickness and a direction of surface.

7 Claims, 8 Drawing Sheets

FIGURE 6
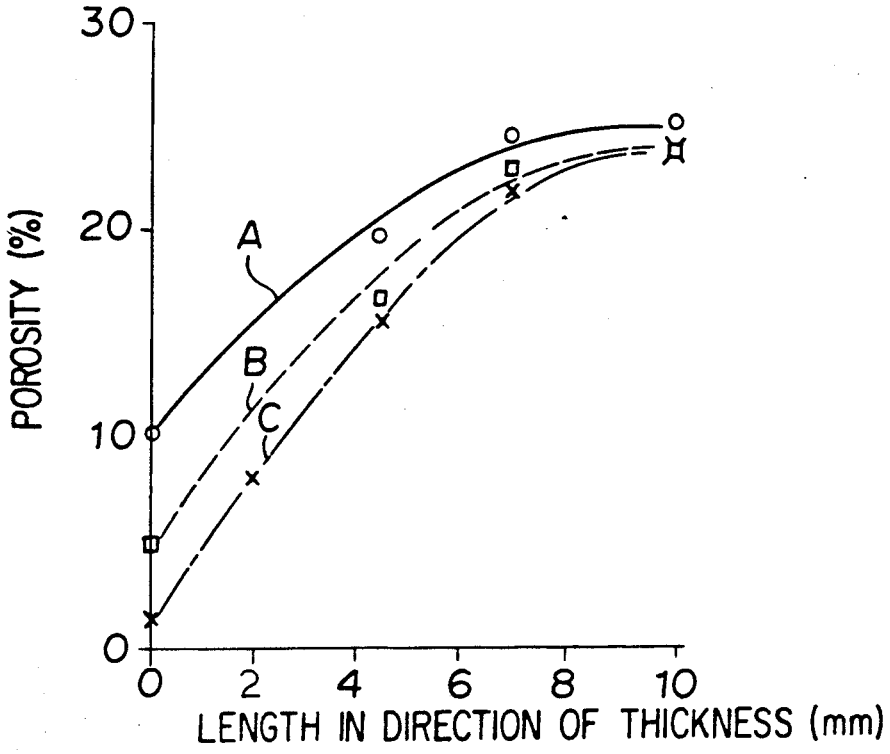
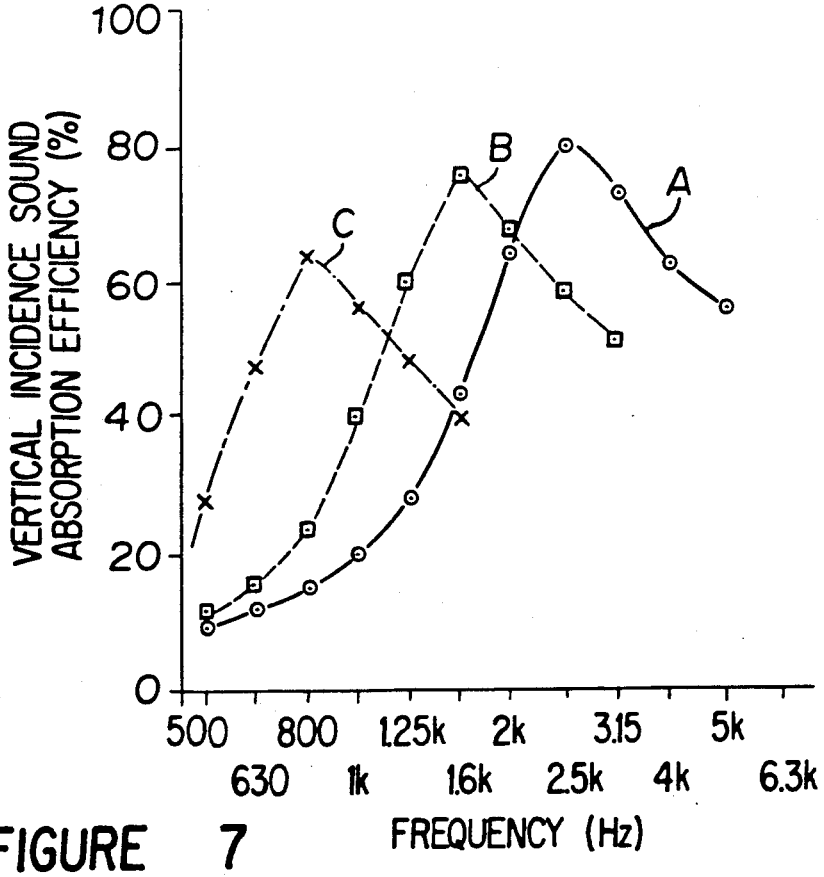
FIGURE 7

BLOWER HAVING A SOUND-DAMPING STRUCTURE

BACKGROUND OF THE INVENTION

1. Field of the Invention

The present invention relates to a blower which is of sound-damping structure.

2. Description of the Related Art

FIG. 13 of the accompanying drawings is a vertical side view in section showing a blower which is of sound-damping structure, as disclosed in e.g. Japanese Unexamined Utility Model Publication No. 114000/1986. FIG. 14 is a front view in section of the blower of FIG. 13. In these Figures, reference numeral 1 designates an impeller which functions to raise the pressure of air or other gases and to deliver it. Reference numeral 2 designates an electric motor which is used to drive the impeller 1. Reference numeral 3 designates a fan casing which comprises a hard porous layer prepared in a porous structure by foaming or sintering a plastic material. Reference numeral 4 designates a fan inlet. Reference numeral 5 designates a fan outlet.

The conventional blower, which is constructed as stated above, draws in it air or other gases through the fan inlet 4 under the action of the impeller 1 rotated by the electric motor 2, and causes the air or gases to flow out from the fan outlet 5. In the course of moving the air from the inlet to the outlet, blower noise which is produced by the impeller 1 emits from the fan inlet 4, the fan outlet 5, and the surface of the fan casing 3. Because the fan casing 3 is made of the porous layer as stated above, most part of the blower noise can be absorbed and damped in the porous layer to suppress the noise which is emitted outside from the inlet and the outlet.

However, in the conventional sound-damping structure for a blower, the porous layer which forms the fan casing 3 is equal in specific gravity in the direction of thickness of the layer and in a direction of surface of the layer. As a result, the layer has to be great in thickness in order to improve sound absorption performance. This creates problems in that the size, the weight, the production cost and the like of the blower are increased. If the porosity in the porous layer is increased as a result of having given importance to sound absorption effect, the porous layer will have a high rate porosity equality in its entirety, the air can leak outside through the fan casing 3, creating a problem wherein aerodynamic performance is lowered.

SUMMARY OF THE INVENTION

It is an object of the present invention to dissolve such problems, and to provide a new and improved blower capable of offering superior sound absorption performance even if its casing is formed to be thin.

It is another object of the present invention to provide a blower capable of improving sound absorption performance in particularly a low frequency band of noise.

It is a further object of the present invention to provide a blower capable of improving the air leak through its fan casing to improve aerodynamic performance.

The foregoing and the other objects of the present invention have been attained by providing a blower comprising an impeller which can function to raise the pressure of a fluid such as air and other gases and delivers it, a driving unit for driving the impeller, and a fan casing which includes a fluid path to inspire the fluid from the outside and deliver it to the outside through the impeller, wherein the fan casing is partly or in its entirety formed by a hard porous structural unit whose specific gravity is continuously changed in the direction of thickness or in a direction of surface.

The hard porous structural unit can be formed to have an inner wall surface provided with a skin layer having a thickness of 100 μm or less.

The blower according to the present invention can ensure sufficient sound absorption performance without making the fan casing thicken because the specific gravity distribution in the fan casing is optimum in terms of sound absorption performance.

In addition, the provision of the skin layer can not only further improve the sound absorption performance in a low frequency band but also prevent a fluid from leaking through the fan casing.

On the other hand, when the porous structural unit without the skin layer is applied to the fan casing of a centrifugal blower, the radial distribution in specific gravity of the porous structural unit should be such that the higher static pressure is, the smaller the porosity of the porous structural unit is generally (the greater the specific gravity is generally) to correspond to the static pressure distribution in the fan casing, in order to significantly improve the deterioration of aerodynamic performance due to air leakage.

BRIEF DESCRIPTION OF THE DRAWING

In the drawings:

FIG. 6 is a graph of characteristic curves showing the porosities of different porous structural units, as testing samples, with respect to the thickness of the samples, for exhibiting the effects offered by changing the specific gravity (porosity) of porous structural units in a direction of surface;

FIG. 7 is a graph of characteristic curves showing the vertical incidence sound absorption efficiencies of the porous structural units with respect to frequency, the porous structural units having the characteristic curves in porosity shown in FIG. 6;

DESCRIPTION OF THE PREFERRED EMBODIMENTS

The present invention will be described in detail with reference to preferred embodiments illustrated in the accompanying drawings.

Figure 1:
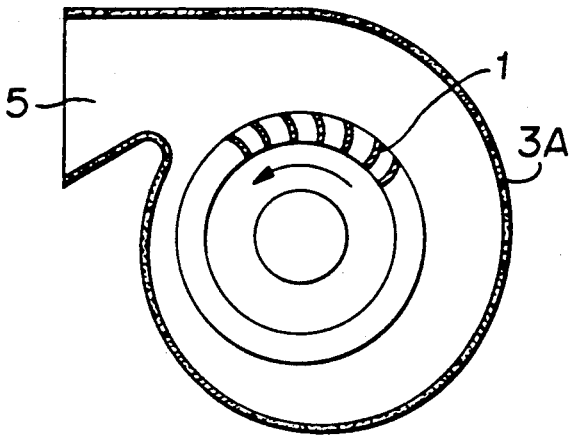
FIG. 1 is a side view in section perpendicular to a shaft showing an embodiment of the blower according to the present invention.
Figure 2:
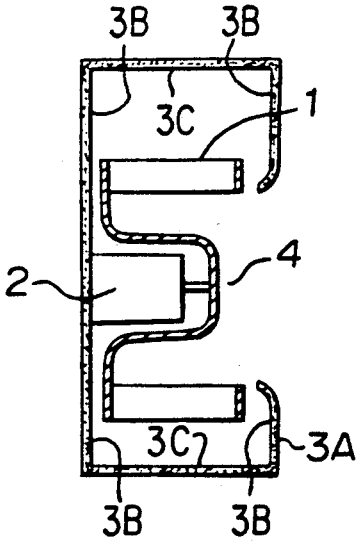
FIG. 2 is a front view in section along the shaft showing the embodiment of FIG. 1.

As shown in FIGS. 1 and 2, an embodiment of the blower according to the present invention is constituted by an impeller 1, an electric motor 2 for driving the impeller 1, and a fan casing 3A which encloses the impeller 1 and the electric motor 2, and which is provided with a fan inlet 4 and a fan outlet 5. The fan casing 3A has a porous structural unit.

Figure 13:
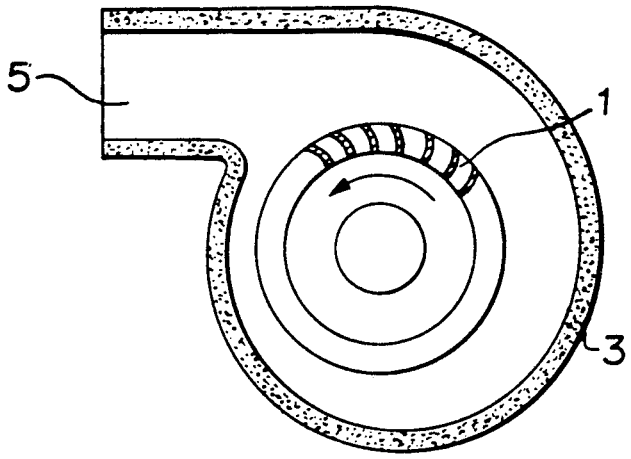
FIGURE 13 PRIOR ART
FIG. 13 is a side view in section perpendicular to a shaft of the conventional centrifugal blower.
Figure 14:
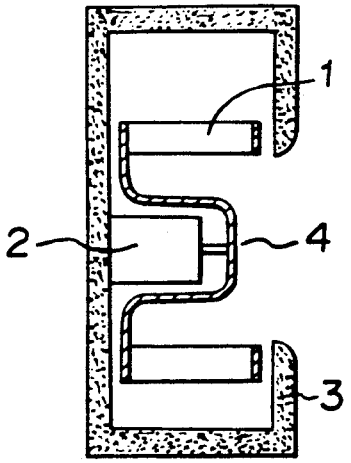
FIGURE 14 PRIOR ART
FIG. 14 is a front view in section along the shaft of the blower shown in FIG. 13.

Although the basic structure of the embodiment is similar to the conventional blower shown in FIGS. 13 and 14, the internal structure of the porous structural unit which constitutes the fan casing 3A is quite different from that of the conventional blower, which will be described in detail later on. The elements other than the fan casing 3A are similar to those of the conventional blower, and these elements are denoted by the same reference numerals as the conventional blower of FIGS. 13 and 14.

The fan casing 3A of the embodiment is constituted by a hard porous structural unit whose specific gravity is continuously changed in the direction of thickness and in a direction of surface. Such special porous structural unit is disclosed in U.S. patent application Ser. No. 07/429,496, filed on Oct. 31, 1989 in the name of Yoshihiro Noguchi et al. (a corresponding EPC Application was filed on Oct. 27, 1989 under Application No. 89119990.3 in the name of Mitsubishi Denki Kabushiki Kaisha et al., and was laid open to the public on May 16, 1990 under Publication No. 0368098.), the teachings of which are hereby incorporated by reference.

Figure 3A:
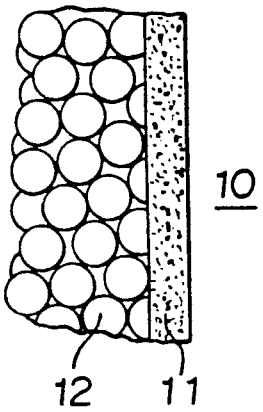
FIGS. 3A and 3B are schematic views in section showing two embodiments of a typical porous structural unit which is utilized in the fan casing according to the present invention.
Figure 3B:
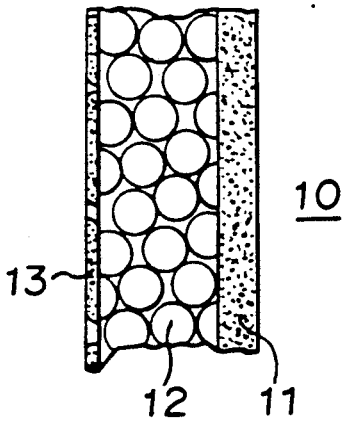
Figure 3C:
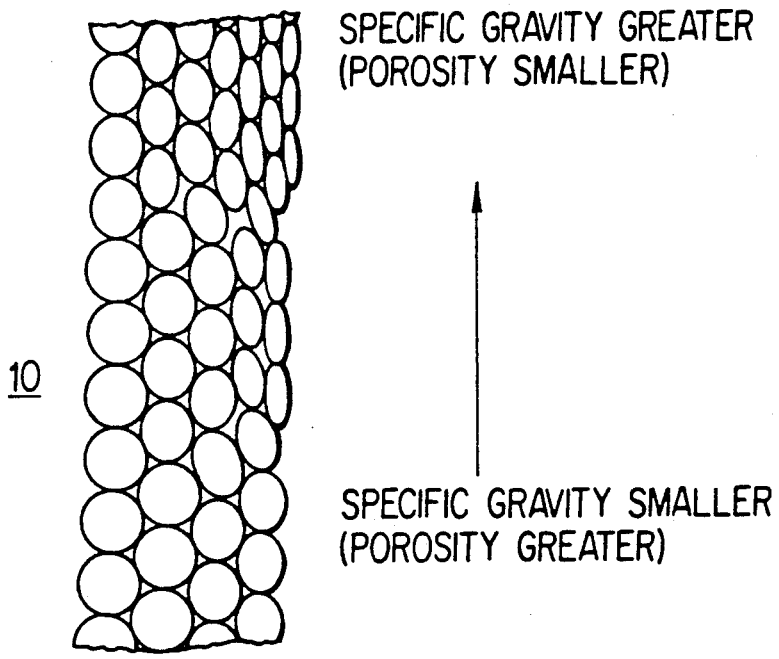
FIG. 3(*c*) is a schematic view of the porous structural unit showing the porosity gradually changing in a surface direction.

The structure of the porous structural unit is as follows:

FIGS. 3(*a*) and 3(*b*) are, respectively, views in section in the direction of thickness wherein embodiments of the porous structural unit for use in the fan casing 3A are shown in forms of model. In these Figures, reference numeral 10 designates the porous structural unit as a whole. The porous structural unit 10 comprises a layer 11 having higher specific gravity, and a porous layer 12 having lower specific gravity. The layer 11 is made of e.g. a fusion layer. Although it is preferable that the fusion layer is not air-permeable, it is safe that the fusion layer is slightly air-permeable. The porous layer 12 is air-permeable, and its porosity is continuously changed in the direction of thickness. In the embodiment of FIG. 3(*b*) a skin layer 13 is provided on the porous layer 12 at the side remote from the fusion layer 11. The skin layer normally has specific gravity which lies between the specific gravity of the fusion layer 11 and that of the porous layer 12. The skin layer 13 can be made of e.g. a fusion layer whose thickness is 100 μm or less The porous layer 12 is arranged to be opposite to a noise source, thereby absorbing and attenuating the noise energy. The fusion layer 11 prevents sound waves from passing through. In the embodiment of FIG. 3(*a*), the porous structural unit 10 is made of the fusion layer 11 and the porous layer 12 which are integral with each other. In the embodiment of FIG. 3(*b*), the porous structural unit 10 is made of the fusion layer 11, the porous layer 12 and the skin layer 13 which are integral with one another.

The porous structural unit 10 can be prepared by e.g. shaping a granular material of thermoplastic resin in a mold comprising a male form and a female form while making the inner surface temperature of the male form and that of the female form differ from each other. A detailed description on the production method of the porous structural unit 10 will be omitted. FIG. 3(*c*) show the porous structural unit 10 without the fusion and skin layers and illustrates a porosity which gradually changes in a surface direction.

Next, the sound absorption performance of the porous structural unit 10 will be explained.

Figure 4:
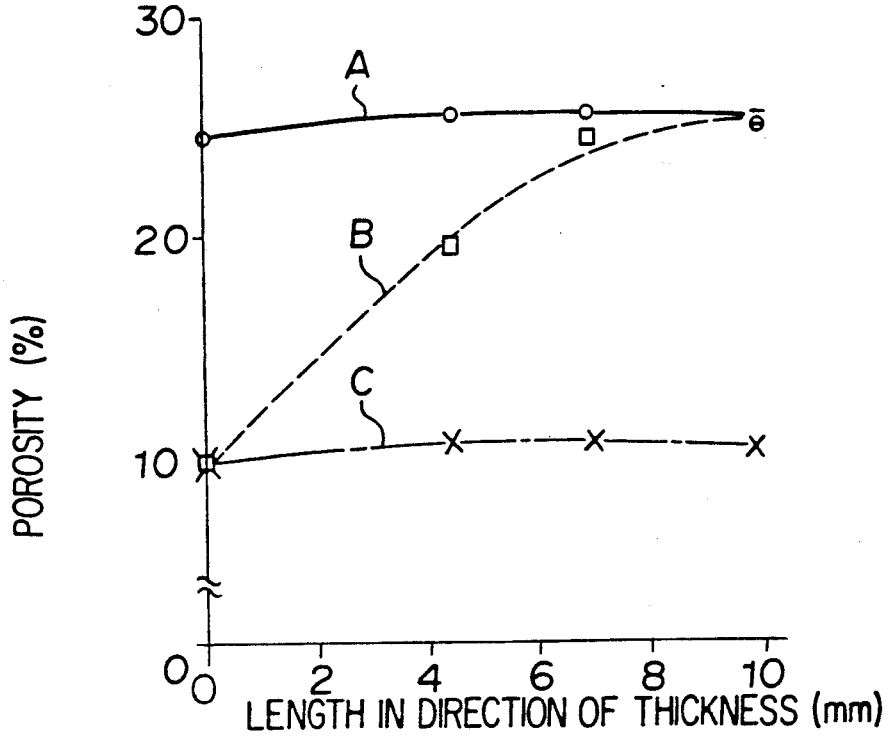
FIG. 4 is a graph of characteristic curves showing the porosities of porous structural units, as testing samples, with respect to the thickness of the samples, two samples A and C having porosities (specific gravities) kept substantially constant in the direction of thickness, and one sample B having porosity (specific gravity) gradually changed in that direction.

FIG. 4 is a graph showing an example of the porosity (specific gravity) distribution in the direction of thickness of porous structural units which are made of a porous layer in their almost entire area and have a thickness of 10 mm. The porous structural units indicated by characteristic curves A and C are substantially equal in porosity in the direction of the thickness, and the porosity is about 25% for the former and about 10% for the latter. The porous structural unit indicated by a characteristic curve B has porosity continuously changed in a range of from 10% to 25% in the direction of thickness.

Figure 5:
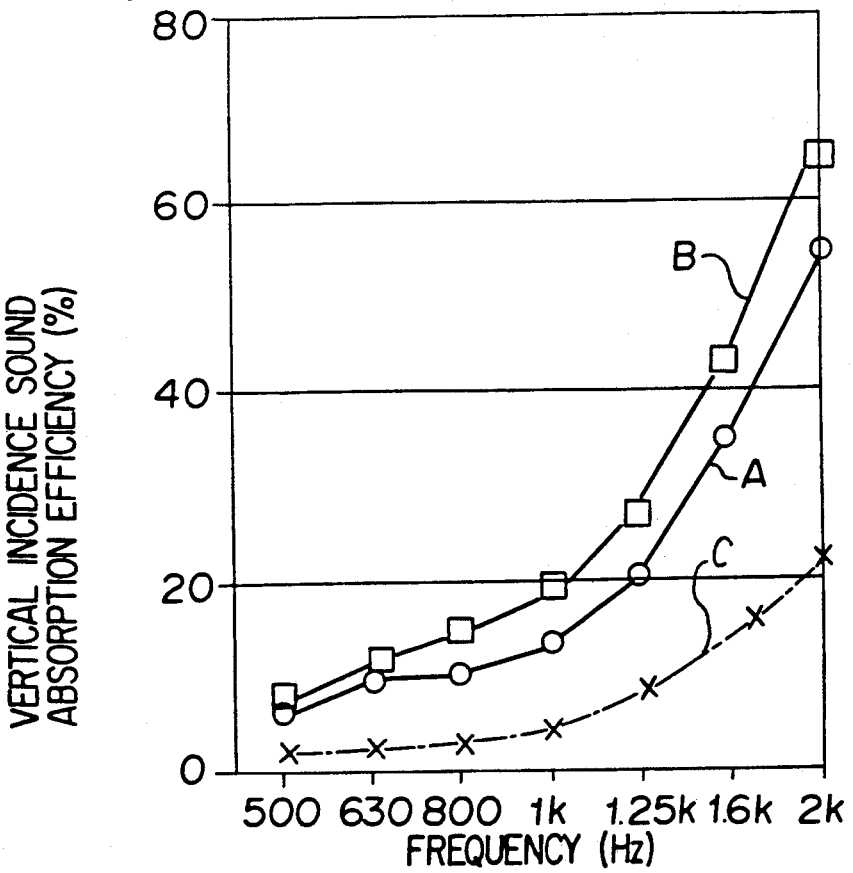
FIG. 5 is a graph of characteristic curves showing the vertical incidence sound absorption efficiencies of the porous structural units with respect to frequency, the porous structural units having the characteristic curves in porosity shown in FIG. 4.

FIG. 5 shows the results which have been obtained by measuring the vertical incidence sound absorption efficiency of the three samples having the characteristics A, B and C of FIG. 4 in accordance with the measurement prescribed in JIS A 1405 "Methods of Test for Sound Absorption of Acoustical Materials by the Tube Method". FIG. 5 shows that the sample having the porosity distribution indicated by the curve B has exhibited the best sound absorption efficiency. By the way, in the embodiment of the blower, the inner side of the fan casing 3A is formed by a lower porosity side (i.e. higher specific gravity side) of the porous structural unit to improve the sound absorption efficiency characteristics because the porous structural unit is formed to have a thin wall thickness. As a result, the inner wall surface of the fan casing 3A can become smoother to decrease friction loss, and simultaneously to improve aerodynamic performance.

The improved sound absorption efficiency which is obtained by changing the porosity (specific gravity) of the porous structural unit in a direction of surface will be explained.

FIG. 6 shows the difference in porosity of three kinds of the porous structural units as samples which are indicated by curves A, B and C, respectively, and have a thickness of 10 mm, the sequence in magnitude of their porosities being first the sample indicated by the curve A, then the sample indicated by the curve B and finally the sample indicated by the curve C. Their sound absorption efficiencies are shown in FIG. 7. FIG. 7 shows that a decrease in the porosity at the side of a sound wave incidence surface is effective to improve sound absorption efficiency in a low frequency band (as indicated by the curve C). It means that it is possible to obtain good sound absorption characteristics over a wide range of frequency bands by giving variety in the distribution of porosity in a direction of the surface of the porous structural unit 10.

In consideration of the sound absorption efficiency characteristics as stated above, a part or the entire of the fan casing 3A can be made of the porous structural unit 10 to obtain the optimum distribution in specific gravity in terms of sound absorption performance, thereby allowing sound absorption performance to be improved even if the fan casing 3A is thinned. As a result, the size, the weight and the production cost of the blower can be decreased.

Although explanation of the embodiments of the porous structural unit has been made for the cases of the presence of variation in specific gravity in the direction of thickness, and the presence of variation in specific gravity in a direction of surface, it will be appreciated that sound absorption performance can be improved in comparison with the conventional blower even if the specific gravity in the porous structural unit is changed in either the direction of thickness or a direction of surface. In many cases, blowers are incorporated into kinds of products for use. In such cases, the blower according to the present invention can be prepared to have the structure wherein the fusion layer 11 is omitted from the porous structural unit 10. The transmission of sound waves is prevented by the casing of the product with the blower incorporated therein. This arrangement can use an air layer between the porous structural unit and the product casing to further improve sound absorption efficiency. Although explanation of the embodiments has been made for the case wherein the kind of the blower is a centrifugal blower, the application of the porous structural unit according to the present invention to other blowers such as axial blowers, mixed flow blowers and cross-flow blowers can be expected to offer similar effects.

By the way, there is a case wherein sound in a quite lower frequency range is dominant depending on the kind or the size of the blower. In order to cope with such a case, the fan casing 3A can have an inner wall surface provided with a skin layer 13 having a thickness of 100 μm or less to significantly improve sound absorption performance in such a lower frequency band. The advantage offered by the provision of the skin layer is disclosed in the U.S. patent application and the EPC Application as stated earlier, the teachings of which are hereby incorporated by reference.

Figure 8:
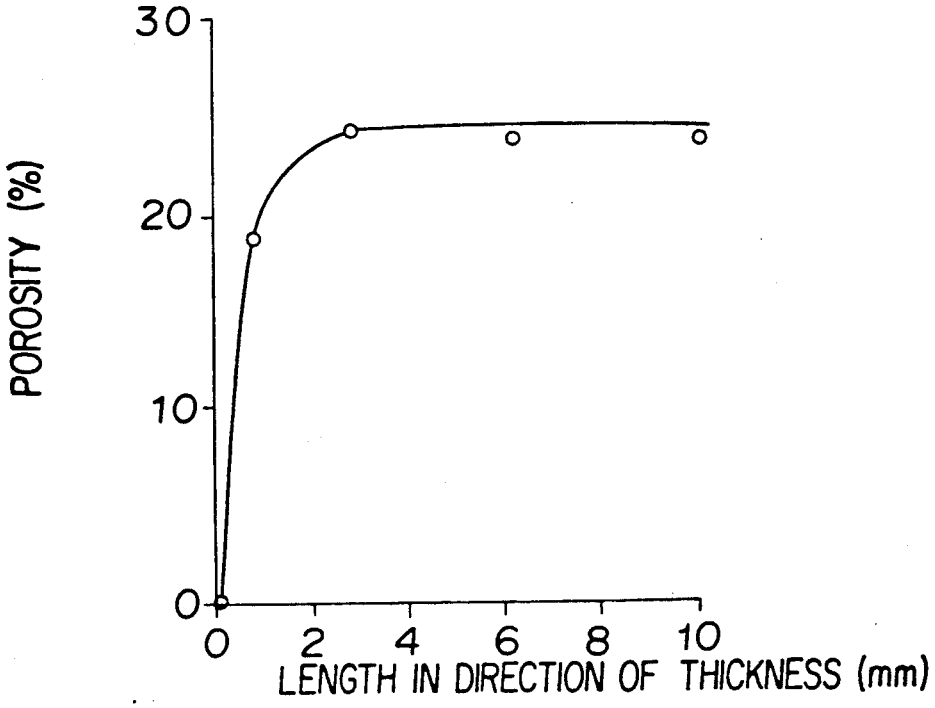
FIG. 8 is a graph of a characteristic curve showing the porosity of a porous structural unit with a skin layer on its one side, with respect to thickness.
Figure 9:
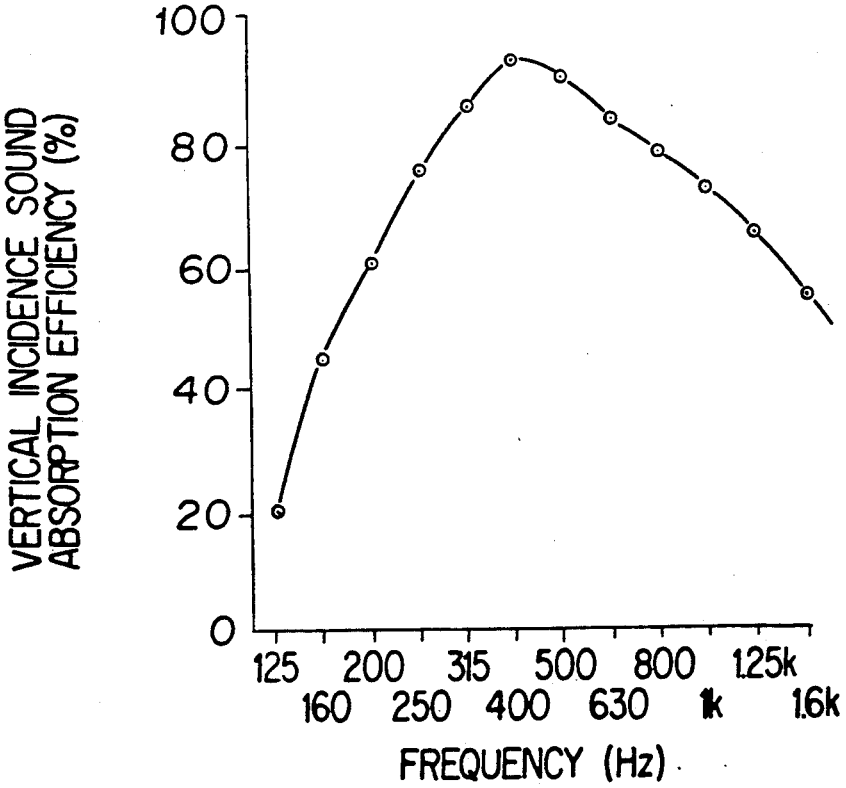
FIG. 9 is a graph of a characteristic curve showing the vertical incidence sound absorption efficiencies of the porous structure with respect to frequency, the porous structural unit having the characteristic curve in porosity shown in FIG. 8.

FIG. 9 shows the vertical incidence sound absorption efficiency characteristics of the porous structural unit as a sample which has a thickness of 10 mm and whose porosity (specific gravity) distribution is as shown in FIG. 8. Obviously from FIG. 9, the sound absorption efficiency in the sample reaches a maximum at a low frequency of 400 Hz, and that the sample has good sound absorption characteristics wherein the maximum value is beyond 90%. As the result of a microscopic observation on the part of the sample which is a lower porosity portion at the side of a sound wave incidence surface and which was cut for the observation, it has been found that the surface becomes an impermeable skin layer 13 which has a thickness of about 30 μm. In addition, sound absorption characteristic tests have been conducted on samples whose skin layers differ from one another in thickness. The results of the tests have indicated that in the case of the presence of skin layers having a thickness of 100 μm or above, conversely the frequency at which sound absorption efficiency reaches a maximum goes up, and that a required effect can not be obtained. This is because the skin layer can be considered to function as an flexible film (spring system) not mass. It has been confirmed that it is adequate to make the skin layer 13 in thickness up to 100 μm. The skin layer is almost impermeable. As a result, even in the case of the porous structural unit 10 without the fusion layer 11, air can be prevented from leaking through the fan casing 3A, and aerodynamic performance can be prevented from lowering.

On the other hand, in the case of middle sized or small sized centrifugal blowers wherein middle and high frequency bands of sound is dominant, it is not appropriate to use a fan casing which is provided with a skin layer 13 to place the maximum sound absorption efficiency in a low frequency band. In addition, blowers are incorporated into kinds of products for use in many cases as stated earlier. In such cases, the blower according to the present invention is usually employed, having the structure without the fusion layer in order to improve sound absorption efficiency. In the case of such blowers, deterioration in aerodynamic performance due to air leakage can be significantly improved by providing characteristic porosity distribution in a direction of surface wherein in order to correspond to the static pressure distribution in the fan casing 3A, porosity of the casing is getting smaller and smaller (i.e. specific gravity is getting greater and greater) depending on the height of the static pressure.

Figure 10:
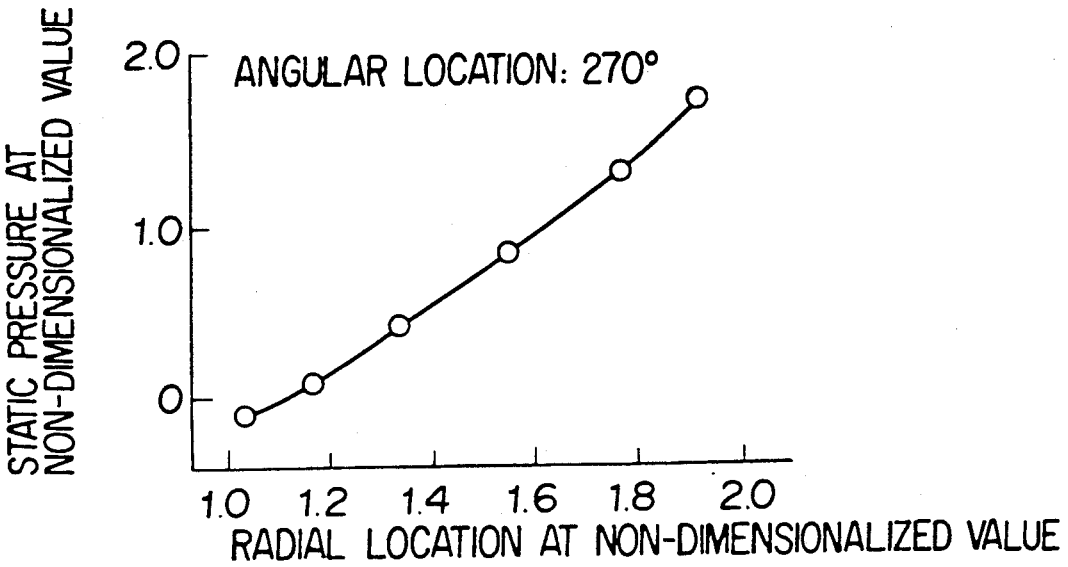
FIG. 10 is a graph of characteristic curve showing the static pressure distribution in a radial direction on an inner side wall of a fan casing at a flow rate in the vicinity of maximum efficiency point of a typical centrifugal blower.

FIG. 10 shows the results which has been obtained by measuring the static pressure radial distribution on an inner side wall of the fan casing at a flow rate in the vicinity of the maximum efficiency point of a representative centrifugal blower. Radial locations are indicated by value which is non-dimensioned based on the radius of the circumference of the impeller 1. Static pressure is indicated by value which is obtained by nondimensioning a change in static pressure with respect to atmospheric pressure at the side of the fan inlet by use of dynamic pressure reduced value ($=\frac{1}{2}\cdot\rho U_0^2$, wherein $\rho$ represents density) indicative of the peripheral speed $U_0$ at the circumference of the impeller. FIG. 10 shows that the static pressure is a little minus at a location corresponding to the circumference of the impeller 1, and that the greater the radius is, the greater the static pressure becomes. It means that the radial distribution in specific gravity of the porous structural unit 10 which forms a side surface 3B of the fan casing 3A should be such that the greater the radius is, the greater the specific gravity continuously becomes, in order to obtain good aerodynamic performance by significantly improving air leakage, and simultaneously to obtain good sound absorption performance in a wide range of frequency bands.

Figure 11:
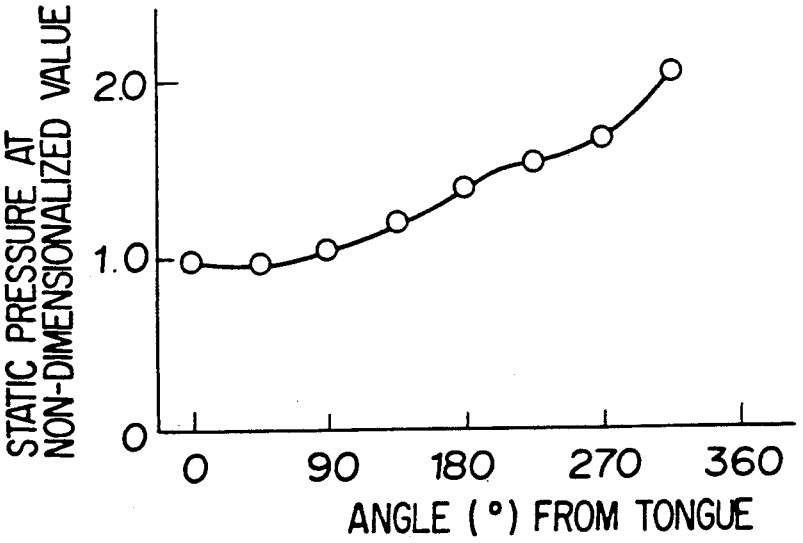
FIG. 11 is a graph of characteristic curve showing the static pressure distribution in the circumferential direction on the inner peripheral wall of the fan casing under the same conditions as FIG. 10.

FIG. 11 also shows the results which have been obtained by measuring the static pressure distribution in the peripheral direction on the inner peripheral wall surface of a fan casing at a flow rate in the vicinity of the maximum efficiency point of a representative centrifugal blower. Locations in the peripheral direction are indicated by angles which are indicative of distance toward the rotational direction of an impeller 1 from the tongue which is the nearest to the impeller 1 and at which the spiral starts. Static pressure is indicated by value which is non-dimensioned in a manner similar to that of FIG. 10. FIG. 11 shows that the static pressure in the vicinity of the tongue is the lowest, and that the bigger the angle is, the greater the static pressure becomes. It means that the distribution in specific gravity in a direction of surface of the porous structural unit 10 which forms the peripheral surface 3C of the fan casing 3A should be such that specific gravity in the vicinity of the tongue becomes the smallest and the further the distance from the tongue is, the greater the specific gravity in the porous structural unit continuously becomes, in order to obtain good aerodynamic performance by improving air leakage, and simultaneously to obtain good sound absorption performance in a wide range of frequency bands.

Figure 12:
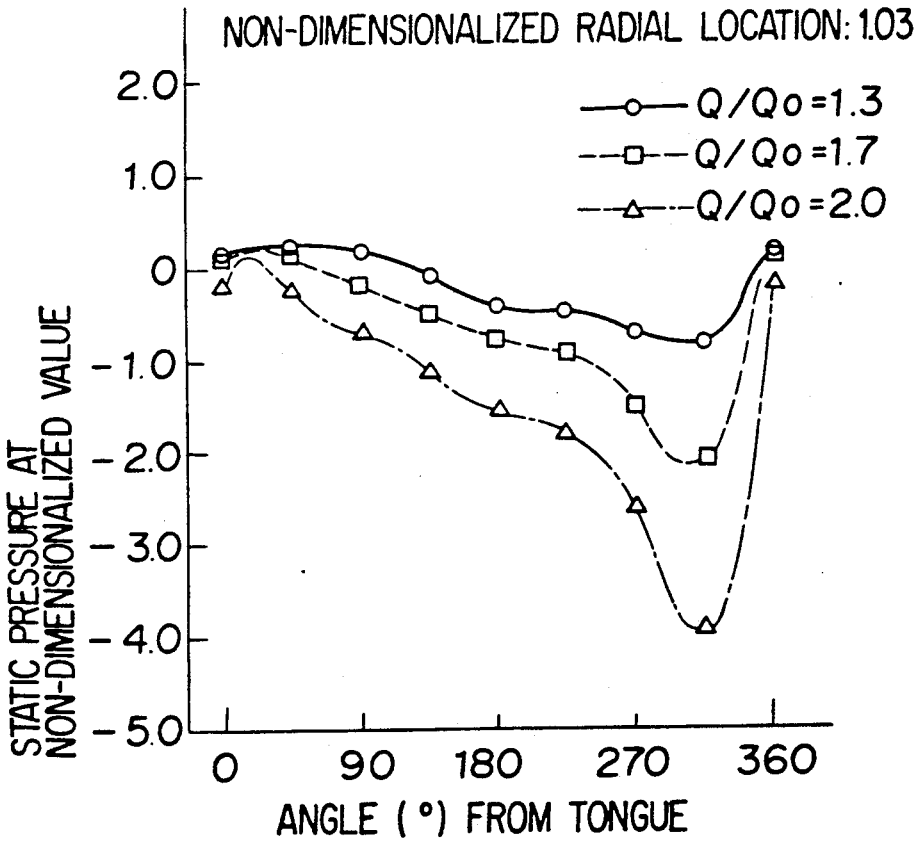
FIG. 12 is a graph of characteristic curve showing the static pressure distribution in the circumferential direction on an inner side wall of the fan casing in the vicinity of the peripheral position of an impeller at a flow rate which is greater than the vicinity of the maximum efficiency point.

FIG. 12 shows the results which have been obtained by measuring the static pressure distribution in the circumferential direction in the vicinity of the circumference of the impeller on an inner side wall of the fan casing at a flow rate which is greater than a flow rate $Q_0$ in the vicinity of the maximum efficiency point of a representative centrifugal blower. Centrifugal blowers are used not only at a flow rate in the vicinity of the maximum efficiency point where the static distribution in the circumferential direction is almost uniform, but also at a flow rate which has greater value, the latter case being often found. In the latter case, the static pressure in the vicinity of the angular location indicative of the tongue is the highest, and the static pressure continuously lowers from the tongue to the vicinity of an angular location which has moved from the tongue to a location greater than approximately three-fourths the angle (360°) at the full circumference toward the rotational direction of an impeller 1, and that the static pressure lowers to a minus great value (the inside of the casing is lower in static pressure) as shown in FIG. 12. It means that in the case of the centrifugal blower used at a flow rate having somewhat great value, the specific gravity distribution in the circumferential direction at the same radial location of the porous structural unit 10 which forms a side surface 3B of the fan casing 3A should be such that the specific gravity in the vicinity of the angular location where the tongue lies is at a maximum and the specific gravity at an angular location which is moved from the angular location of the tongue to a location having greater than approximately three-fourths the angle at the full circumference toward the rotational direction of the impeller 1 is at a minimum, in order to remarkably improve the air leakage from the inside of the fan casing to outside. In addition, in some instances, the presence of inflow air into the inside from the outside of the fan casing can increase the flow rate of air to significantly improve aerodynamic performance, and simultaneously to obtain good sound absorption performance in a wide range of frequency bands.

With respect to such three kinds of characteristic specific gravity distribution in a direction of surface, only one of them can be adopted to obtain the advantage of the present invention to some extent. In response to conditions under which the blower is used, the combination of such kinds of specific gravity distribution can be adopted to offer the advantage in a significant manner.

What is claimed is:

1. A blower comprising:

an impeller for raising the pressure of fluid and delivering said fluid;

means for driving the impeller; and a fan casing which includes a fluid path to inspire the fluid from the outside and deliver it to the outside through the impeller;

wherein the fan casing is at least partly formed by a hard porous structural unit whose specific gravity is continuously changed in at least one of a thickness direction and a surface direction of said porous structural unit, the blower is a centrifugal type blower, the porous structural unit is substantially in the form of a plate and forms a side surface of the fan casing, and the porous structural unit has such a radial distribution in specific gravity that its specific gravity becomes greater and its porosity becomes smaller in a direction toward a periphery of the fan casing in an area which is located outside a location corresponding to a periphery of the impeller.

2. A blower according to claim 1, wherein the porous structural unit is of a spiral structure and forms the outer peripheral surface of the fan casing, the porous structural unit has such a specific gravity distribution in a direction of surface that the specific gravity in the vicinity of a location of a tongue which is nearest to the impeller is at a minimum, and the specific gravity becomes greater and the porosity becomes smaller toward the direction away from the location of the tongue.

3. A blower according to claim 1, wherein the specific gravity distribution in a circumferential direction at the same radial location at least beyond the location corresponding to the periphery of the impeller is such that the specific gravity in the vicinity of the angular location of a tongue which is the nearest to the impeller is a maximum, and the specific gravity at an angular location which is moved from the angular location of the tongue to a location having a greater angle than approximately three-fourths the angle at the full circumference toward the rotational direction of the impeller is a minimum while the specific gravity and the porosity is gradually changed in an area between the angular location having the maximum value and the angular location having the minimum value.

4. A blower according to claim 2, wherein the specific gravity distribution in a circumferential direction at the same radial location at least beyond the location corresponding to the periphery of the impeller is such that the specific gravity in the vicinity of the angular location of the tongue which is the nearest to the impeller is a maximum, and the specific gravity at an angular location which is moved from the angular location of the tongue to a location having a greater angle than approximately three-fourths the angle at the full circumference toward the rotational direction of the impeller is a minimum while the specific gravity and a porosity is gradually changed in the area between the angular location having the maximum value and the angular location having the minimum value.

5. A blower comprising:

an impeller for raising the pressure of a fluid and delivering said fluid;

means for driving the impeller; and a fan casing which includes a fluid path to inspire the fluid from the outside and deliver it to the outside through the impeller;

wherein the fan casing is as least partly formed by a hard porous structural unit whose specific gravity is continuously changed in at least one of a thickness direction and a surface direction of said porous structural unit, the blower is a centrifugal type blower, the porous structural unit forms an outer peripheral surface of the fan casing and is of a spiral structure, and the porous structural unit has such a specific gravity distribution in a direction of its surface that the specific gravity in the vicinity of the location of a tongue which is the nearest to the impeller is at a minimum, and the specific gravity and a porosity becomes greater toward a direction away from the location of the tongue.

6. A blower according to claim 5, wherein the blower is of centrifugal type, wherein the porous structural unit is substantially in the form of plate and forms a side surface of the fan casing, and wherein the specific gravity distribution in the circumferential direction at the same radial location at least beyond the location corresponding to the periphery of the impeller is such that the specific gravity in the vicinity of the angular location of the tongue which is the nearest to the impeller is a maximum, and the specific gravity at an angular location which is moved from the angular location of the tongue to a location having a greater angle than approximately three-fourths the angle at the full circumference toward the rotational direction of the impeller is a minimum while the specific gravity and a porosity is gradually changed in the area between the angular location having the maximum value and the angular location having the minimum value.

7. A blower comprising:

an impeller for raising the pressure of a fluid and delivering said fluid;

means for driving the impeller; and a fan casing which includes a fluid path to inspire the fluid from the outside and deliver it to the outside through the impeller;

wherein the fan casing is at least partly formed by a hard porous structural unit whose specific gravity is continuously changed in at least one of a thickness direction and a surface direction of said porous structural unit, the blower is a centrifugal type blower, the porous structural unit is substantially in the form of plate and forms a side surface of the fan casing, the specific gravity distribution in the circumferential direction at the same radial location at least beyond the location corresponding to a periphery of the impeller is such that the specific gravity in the vicinity of the angular location of a tongue which is the nearest to the impeller is a maximum, and the specific gravity at an angular location which is moved from the angular location of the tongue to a location having a greater angle than approximately three-fourths the angle at the full circumference toward the rotational direction of the impeller is a minimum while the specific gravity and a porosity is gradually changed in the area between the angular location having the maximum value and the angular location having the minimum value.

* * * * *